US005272034A

United States Patent [19]

Kawano et al.

[11] Patent Number: 5,272,034

[45] Date of Patent: Dec. 21, 1993

[54] PROCESS FOR PRODUCING ELECTROPHOTOGRAPHIC TONER

[75] Inventors: Nobuaki Kawano, Higashiosaka; Nobuyuki Tsuji, Kakogawa; Takatomo Fukumoto, Osaka; Kaoru Tanaka, Daito; Masanori Fujii, Sakai; Atsushi Yamaguchi; Kazuhiko Fujii, both of Nara; Koji Okuda, Hirakata, all of Japan

[73] Assignee: Mita Industrial Co., Ltd., Japan

[21] Appl. No.: 913,051

[22] Filed: Jul. 14, 1992

[30] Foreign Application Priority Data

Jul. 22, 1991 [JP] Japan ..... 3-181068
Jul. 22, 1991 [JP] Japan ..... 3-181069
Jul. 30, 1991 [JP] Japan ..... 3-189857

[51] Int. Cl.[5] ..... G03G 9/00; G03G 9/097; G03G 9/09

[52] U.S. Cl. ..... 430/137

[58] Field of Search ..... 430/137

[56] References Cited

U.S. PATENT DOCUMENTS 5,147,753 9/1992 Hikake ..... 430/137

FOREIGN PATENT DOCUMENTS 405912 1/1991 European Pat. Off. .
415727 3/1991 European Pat. Off. .
289856 12/1987 Japan ..... 430/137

*Primary Examiner*—Roland Martin
*Attorney, Agent, or Firm*—Beveridge, DeGrandi, Weilacher & Young

[57] ABSTRACT

In accordance with the present invention, the electrophotographic toner is produced by dispersing and mixing toner components containing a fixing resin, a coloring agent and an electric charge controlling dye, and by melting and kneading the resulting mixture, which is then subjected to pulverizing and classifying. According to the present invention, fine powder generated at the pulverizing and classifying steps is reused as added to a mixture of toner components as already dispersed and mixed at the dispersing and mixing step, and the surface dye density of the electric charge controlling dye is in the range from $1.0\times10^{-3}$ to $1.7\times10^{-3}$ g/g, or the rate of the amount of an electric charge controlling dye present on the surfaces of toner particles to the total amount of the electric charge controlling dye, is in the range from 10 to 27% by weight. Even though repeatedly used for a long period of time, the electrophotographic toner does not lower the developer in electric charging characteristics. Further, by adding the fine powder to the mixture as already dispersed and mixed at the dispersing and mixing step, there can be efficiently produced a fine-powder regenerated toner excellent in transfer efficiency, resolution and gradation.

2 Claims, 3 Drawing Sheets

PROCESS FOR PRODUCING ELECTROPHOTOGRAPHIC TONER

BACKGROUND OF THE INVENTION

The present invention relates to an electrophotographic toner and more particularly to an electrophotographic toner to be used for an image forming apparatus such as an electrostatic copying apparatus, a laser beam printer or the like.

In the image forming apparatus above-mentioned, the surface of a photoreceptor is exposed to light to form an electrostatic latent image on the surface of the photoreceptor. A developer containing an electrophotographic toner and a carrier is let come in contact with the surface of the photoreceptor. The electrophotographic toner is electrostatically stuck to the electrostatic latent image, so that the electrostatic latent image is formed into a toner image. From the photoreceptor surface, the toner image is transferred to and fixed on paper. Thus, an image corresponding to the electrostatic latent image is formed on the paper surface.

As the electrophotographic toner above-mentioned, there may be used one as obtained by blending a fixing resin with a coloring agent such as carbon black or the like, an electric charge controlling dye and the like and by pulverizing the blended body into particles having sizes in a predetermined range.

It is known that the electric charging characteristics of such an electrophotographic toner greatly depend on a surface dye density which refers to the amount, per one gram of toner particles, of the electric charge controlling dye which is exposed onto the surfaces of toner particles and which contributes to the generation of an electric charge.

To improve the electric charging characteristics, there has been proposed an electrophotographic toner improved in surface dye density to the range from $4.0\times10^{-3}$ to $9.0\times10^{-3}$ g/g as compared with the conventional range from $2.0\times10^{-3}$ to $4.0\times10^{-3}$ g/g (Japanese Patent Unexamined Application No. 36757/1986).

The surface dye density is obtainable in the following manner. That is, the dye present on the surfaces of toner particles is selectively extracted by a solvent such as methanol or the like which dissolves only the electric charge controlling dye, and the solution thus extracted is measured by an absorbance measuring method or the like to obtain the amount of the extracted dye, which is then converted into the amount of dye per toner of 1 gram.

It is found that, when a conventional electrophotographic toner including a toner improved in surface dye density is repeatedly used for a long period of time in a high-speed-type image forming apparatus in which the image forming speed is high, the developer is lowered in electric charging characteristics, causing troubles such as "forward flow", toner scattering, unstable image density and the like. The term of "forward flow" refers to a phenomenon that an excessive amount of toner electrostatically stuck to an electrostatic latent image due to low electric charging characteristics, is rubbed by a magnetic brush of a developing device and flows forward in the image forming direction.

Upon study of the reasons of the troubles above-mentioned, the following has been made clear. In a high-speed image forming apparatus, the developer is stirred under severer conditions than in a normal image forming apparatus. Accordingly, when the developer is repeatedly used for a long period of time, the dye exposed onto the surfaces of toner particles falls off therefrom to deteriorate the carrier. This lowers the entire developer in electric charging characteristics, thus causing the troubles above-mentioned.

Upon study from another point of view, the following has been made clear. In a conventional electrophotographic toner, the toner-surface presence rate of electric charge controlling dye, i.e., the rate of the amount of a dye present on the surfaces of toner particles to the total amount of the dye, is as high as 30 to 90% by weight. This means that a great amount of electric charge controlling dye is exposed to the surfaces of toner particles. Accordingly, in a high-speed image forming apparatus, the dye exposed to the surfaces of toner particles falls off therefrom as mentioned earlier, thus deteriorating the carrier. Thus, the entire developer is lowered in electric charging characteristics.

On the other hand, the electrophotographic toner is prepared by dispersing and mixing toner components such as a fixing resin, a coloring agent, an electric charge controlling dye, a releasing agent (off-set preventive agent) and the like, and by melting and kneading the resultant mixture, which is then pulverized and classified.

At the pulverizing and classifying steps, there is generated fine powder of which size does not reach a predetermined one. This greatly lowers the material yield. To improve the material yield, as shown in a flow chart in FIG. 3, such fine powder is reused as added to toner materials before the toner materials are dispersed and mixed.

More specifically, the respective components forming an electrophotographic toner, such as a fixing resin, a coloring agent, an electric charge controlling dye, a releasing agent (off-set preventive agent) and the like are blended in a predetermined blending proportion together with fine powder, and then dispersed and mixed with each other (step 1).

The resulting mixture is then molten and kneaded (step 2), and the resultant molten and kneaded body is cooled and solidified, and the resultant solidified body is subjected to coarse pulverizing, fine pulverizing and classification (steps 3 to 5), thus producing an electrophotographic toner having a predetermined particle size.

However, when the toner thus produced with fine powder reused as above-mentioned (hereinafter referred to as fine-powder regenerated toner) is used for a two-component developer, the following troubles are caused.

1) The amounts of consumed and collected toner are increased, thereby to lower the transfer efficiency.

2) Toner scattering contaminates the inside of an image forming apparatus, resulting in contamination of a reproduced copy due to toner falling.

3) A formed image blots.

4) In a formed image, gradation is lost so that the image tone becomes hard.

Upon study of the reasons of why the conventional fine-powder regenerated toner presents the problems above-mentioned, the following has made clear.

In a normal toner production method, at the step of dispersing and mixing the respective components, the component particles are finely pulverized and uniformly mixed upon reception of a shear force generated by mixing. However, when fine powder is added to the components before they are dispersed and mixed, the fine powder serves as a sliding material and therefore prevents the components from being pulverized by a shear force. Accordingly, the components cannot be sufficiently finely pulverized but remain in the form of relatively large lumps. In particular, the electric charge controlling dye incompatible with the fixing resin remains in the form of large lumps even in the subsequent melting and kneading step. Accordingly, on the surface of the fine-powder regenerated toner thus produced, the electric charge controlling dye is present in the form of relatively large lumps which are liable to readily fall off from the toner particles.

Accordingly, when the fine-powder regenerated toner as above-mentioned is repeatedly used together with a carrier in an image forming process for a long period of time, the electric charge controlling dye falls off from the toner particles to contaminate the carrier, thereby to deteriorate the electric charging characteristics of the developer in its entirety. Thus, the troubles above-mentioned are caused.

Alternately, it is proposed to lengthen the dispersing and mixing period of time as compared with a conventional period of time in order to promote the pulverization of the components. However, since the added fine powder serves as a sliding material, the expected effect cannot be produced. On the contrary, as the dispersing and mixing period of time is lengthened, the productivity is accordingly decreased.

SUMMARY OF THE INVENTION

It is a main object of the present invention to provide an electrophotographic toner involving no likelihood to lower the developer in electric charging characteristics even though the toner is repeatedly used for a long period of time.

It is another object of the present invention to provide an electrophotographic toner which prevents a decrease in transfer efficiency and toner scattering due to falling-off of the electric charge controlling dye, and with which an image excellent in gradation is produced.

It is a further object of the present invention to provide an electrophotographic toner producing method capable of producing a fine-powder regenerated toner with high productivity.

According to the present invention, an electrophotographic toner is produced by subjecting toner components including a fixing resin, a coloring agent and an electric charge controlling dye, to dispersing & mixing, melting & kneading, pulverizing and classifying, fine powder generated at the pulverizing and classifying steps is added to a mixture of toner components as dispersed and mixed at the dispersing & mixing step, and the surface dye density of the electric charge controlling dye is in the range from $1.0\times10^{-3}$ to $1.7\times10^{-3}$ g/g.

In the electrophotographic toner of the present invention, since the surface dye density is low, the amount of a dye falling off from the surfaces of toner particles is small, resulting in a decrease in carrier contamination due to falling dye.

According to the present invention, after the respective components forming a toner have been sufficiently dispersed and mixed, fine powder is added to a mixture of the components. Thus, there is produced an electrophotographic toner in which the electric charge controlling dye is being dispersed as finely pulverized. This lessens the amount of an electric charge controlling dye falling off from the surfaces of toner particles. It is therefore possible to obtain a fine-powder regenerated toner free from the problems above-mentioned due to falling of the electric charge controlling dye.

The surface dye density is limited to the range above-mentioned for the following reasons. If the surface dye density is greater than $1.7\times10^{-3}$ g/g, there is increased the amount of an electric charge controlling dye which falls off from the toner particles to contaminate the carrier when the toner is repeatedly used for a long period of time. This lowers the developer in electric charging characteristics, causing the problems of "forward flow", toner scattering, unstable image density and the like. On the other hand, if the surface dye density is less than $1.0\times10^{-3}$ g/g, the toner itself is lowered in electric charging characteristics. This lowers the developer in electric charging characteristics at the early stage of image forming, thus causing the problems above-mentioned.

According to another phase of the present invention, the electrophotographic toner is produced by subjecting toner components including a fixing resin, a coloring agent and an electric charge controlling dye, to dispersing & mixing, melting & kneading, pulverizing and then classifying, fine powder generated at the pulverizing and classifying steps is added to a mixture of toner components as dispersed and mixed at the dispersing & mixing step, and the rate of the amount of an electric charge controlling dye present on the surfaces of toner particles to the total amount of the electric charge controlling dye, is in the range from 10 to 27% by weight.

According to the electrophotographic toner of the present invention, the amount of a dye present on the surface of toner particles and adapted to fall off therefrom due to stirring or the like, is small, resulting in a decrease in carrier contamination due to falling dye.

The surface presence rate of dye is limited to the range above-mentioned for the following reasons. If the surface presence rate of dye is greater than 27% by weight, there is increased the amount of an electric charge controlling dye which falls off from the toner particles to contaminate the carrier when the toner is repeatedly used for a long period of time. This lowers the developer in electric charging characteristics, causing the problems of "forward flow", toner scattering, unstable image density and the like. On the other hand, if the surface presence rate of dye is less than 10% by weight, the surface dye density is relatively lowered to lower the toner itself in electric charging characteristics. This lowers the developer in electric charging characteristics at the early stage of image forming, thus causing the problems above-mentioned.

According to the method of producing an electrophotographic toner of the present invention, toner components including a fixing resin, a coloring agent and an electric charge controlling dye, is subjected to dispersing & mixing, melting & kneading, pulverizing and then classifying, and fine powder generated at the pulverizing and classifying steps is added to a mixture of toner components as dispersed and mixed at the dispersing & mixing step. In the method above-mentioned, the dispersing & mixing step preferably includes a first dispersing & mixing step and a second dispersing & mixing step. At the first dispersing & mixing step, the respective toner components are dispersed and mixed, and at the second dispersing & mixing step, the toner components are further dispersed and mixed with the fine powder added thereto.

DETAILED DESCRIPTION OF THE INVENTION

Figure 1:
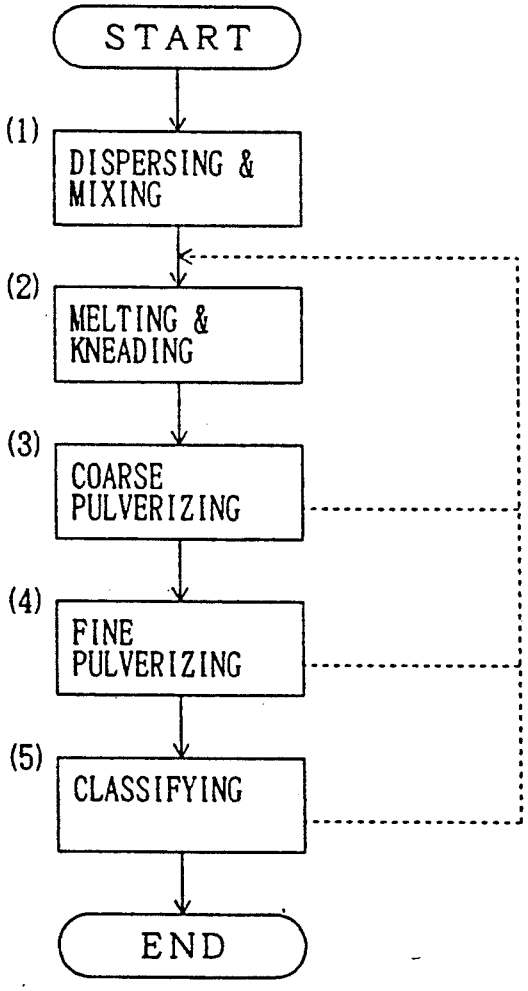
FIG. 1 is a flow chart showing an embodiment of a method of producing an electrophotographic toner according to the present invention.

According to the present invention, the electrophotographic toner may be produced by mixing with a fixing resin, components such as a coloring agent, an electric charge controlling dye, a releasing agent (off-set preventive agent) and the like, and by pulverizing and classifying the resultant mixture into particles having sizes in a predetermined range.

Examples of the fixing resin include styrene resins (monopolymers and copolymers containing styrene or a styrene substituent) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (a styrene-methyl acrylate copolymer, a styrene-ethyl acrylate copolymer, a styrene-butyl acrylate copolymer, a styrene-octyl acrylate copolymer, a styrene-phenyl acrylate copolymer or the like), a styrene-methacrylate copolymer (a styrene-methyl methacrylate copolymer, a styrene-ethyl methacrylate copolymer, a styrene-butyl methacrylate copolymer, a styrene-phenyl methacrylate copolymer or the like), à styrene-α-methyl chloroacrylate copolymer, a styrene-acrylonitrile-acrylate copolymer and the like. Examples of the fixing resin further include polyvinyl chloride, low-molecular-weight polyethylene, low-molecular-weight polypropylene, an ethylene-ethyl acrylate copolymer, polyvinyl butyral, an ethylene-vinyl acetate copolymer, rosin modified maleic acid resin, phenolic resin, epoxy resin, polyester resin, ionomer resin, polyurethane resin, silicone resin, ketone resin, xylene resin, polyamide resin and the like. The examples above-mentioned of the fixing resin may be used alone or in combination of plural types.

Of these, the styrene resin is preferred, and the styrene-acrylic copolymer such as a styrene-acrylate copolymer or a styrene-methacrylate copolymer is more preferred.

As a styrene monomer forming the styrene-acrylic copolymer, there may be used vinyltoluene, α-methylstyrene or the like, besides styrene. As an acrylic monomer, there may be used a monomer represented by the following general formula (I):

$$CH_2{=}\overset{\overset{R^1}{|}}{C}{-}CO{-}O{-}R^2 \qquad (I)$$

(wherein $R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group).

Examples of the acrylic monomer represented by the general formula (I), include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate, tetraethylene glycol dimethacrylate and the like.

The copolymers above-mentioned may be prepared from respective monomers according to a conventional polymerizing method such as a solution polymerization or the like.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black

White

Zinc white, Titanium oxide, Antimony white, Zinc sulfide

Red

Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B

Orange

Chrome orange, Molybdenum orange, Permanent orange GTR, Pyrazolone orange, Vulcan orange, Indanthrene brilliant orange RK, Benzidine orange G, Indanthrene brilliant orange GK

Yellow

Chrome yellow, Zinc yellow, Cadmium yellow, Yellow iron oxide, Mineral fast yellow, Nickel titanium yellow, Naples yellow, Naphthol yellow S, Hansa yellow G, Benzidine yellow 10G, Benzidine yellow G, Benzidine yellow GR, Quinoline yellow lake, Permanent yellow NCG, Tartrazine lake

Green

Chrome green, Chromium oxide, Pigment green B, Malachite green lake, Fanal yellow green G

Blue

Prussian blue, Cobalt blue, Alkali blue lake, Victoria blue lake, Partially chlorinated phthalocyanine blue, Fast sky blue, Indanthrene blue BC

Violet

Manganese violet, Fast violet B, Methyl violet lake

Examples of the extender pigment include Baryte powder, barium carbonate, clay, silica, white carbon, talc, alumina white and the like.

Examples of the conductive pigment include conductive carbon black, aluminium powder and the like.

Examples of the magnetic pigment include a variety of ferrites such as triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 30 parts by weight and preferably from 2 to 20 parts by weight for 100 parts by weight of the fixing resin.

As the electric charge controlling dye, there may be used either one of two different electric charge controlling dyes of the positive charge controlling type and the negative charge controlling type.

As the electric charge controlling dye of the positive charge controlling type, there may be used, for example, a basic dye, aminopyrine, a pyrimidine compound, a polynuclear polyamino compound, aminosilane, a filler of which surface is treated with any of the substances above-mentioned. Preferably, there may be used Black 1, 2, 3, 5, 7 according to the color index classification C. I. Solvet (oil soluble dyes).

As the electric charge controlling dye of the negative charge controlling type, there may be used a compound containing a carboxy group (such as metallic chelate alkyl salicylate or the like), a metal complex salt dye, fatty acid soap, metal salt naphthenate or the like. Preferably, there may be used an alcohol-soluble complex salt azo dye containing chromium, iron or cobalt. More preferably, there may be used a sulfonyl amine derivative of copper phthalocyanine or a metal-containing monoazo dye of the 2:1 type represented by the following formula (II):

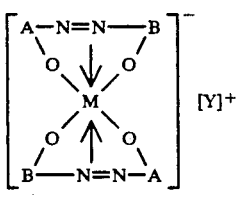

(II)

(wherein A is a residual group of a diazo component having a phenolic hydroxyl group at the ortho-position; B is a residual group of a coupling component; M is a chromium, iron, aluminium, zinc or cobalt atom; and $[Y]^+$ is an inorganic or organic cation).

The electric charge controlling dye may be used in an amount from 0.1 to 10 parts by weight and more preferably from 0.5 to 8 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from about 1,000 to about 10,000. More specifically, there is suitably used one or a combination of plural types of low-molecular-weight polypropylene, low-molecular-weight polyethylene, paraffin wax, a low-molecular-weight olefin polymer composed of an olefin having 4 or more carbon atoms and the like.

The release agent may be used in an amount from 0.1 to 10 parts by weight and preferably from 0.5 to 8 parts by weight for 100 parts by weight of the fixing resin.

The following description will discuss an example of the method of producing the electrophotographic toner of the present invention with reference to a flow chart shown in FIG. 1.

Components forming an electrophotographic toner such as a fixing resin, a coloring agent, an electric charge controlling dye, a release agent (off-set preventive agent) and the like are dispersed and mixed as blended in respective predetermined amounts (step 1) with the use of any of conventional dispersing and mixing devices such as a dry blender, a Henschel mixer, a ball mill or the like.

At the dispersing & mixing step, fine powder serving as a sliding material is not added, so that the components can be finely pulverized and uniformly mixed upon reception of a shear force generated by mixing.

Added to the dispersed mixture is fine powder generated at a pulverizing step and a classifying step to be discussed later. The resulting mixture is then molten and kneaded (step 2). Such melting and kneading may be made with the use of any of conventional kneading devices such as a Banbury mixer, a roll, a single-or double-shaft extruding kneader and the like.

At the melting & kneading step, the fixing resin and components compatible therewith are molten, and components uncompatible therewith such as the electric charge controlling dye or the like are uniformly dispersed in the molten resin.

Then, the molten and kneaded body is cooled and solidified. The cooled and solidified body is then subjected to coarse pulverizing, fine pulverizing and classifying (steps 3 to 5), thus producing an electrophotographic toner having a predetermined particle size. There may be used pulverizing devices such as a feather mill for coarse pulverizing and a jet mill for fine pulverizing. For classification, there may be used a conventional classifying method such as a multiple screening or the like.

At the coarse pulverizing, fine pulverizing and classifying steps, there is generated fine powder of which size is smaller than the particle size of a toner. At the dispersing & mixing step, such fine powder is added to the mixture of the components as dispersed and mixed. Thus, the fine powder can be reused in production of an electrophotographic toner.

In the production process shown in FIG. 1, the fine powder generated at each of the coarse pulverizing, fine pulverizing and classifying steps is added to a mixture of toner components as already dispersed and mixed. Accordingly, in the mixture obtained at the dispersing & mixing step, the components are finely pulverized and uniformly mixed upon reception of a shear force generated by mixing. In the resulting fine-powder regenerated toner obtained through the subsequent steps, the amount of an electric charge controlling dye falling off from the surfaces of toner particles is lessened, thus presenting no problems caused by falling of an electric charge controlling dye. The production steps including the dispersing & mixing step take the same time as in a normal toner producing method according to which fine powder is not added. Thus, the production method in FIG. 1 can efficiently produce a fine-powder regenerated toner having excellent characteristics.

Figure 2:
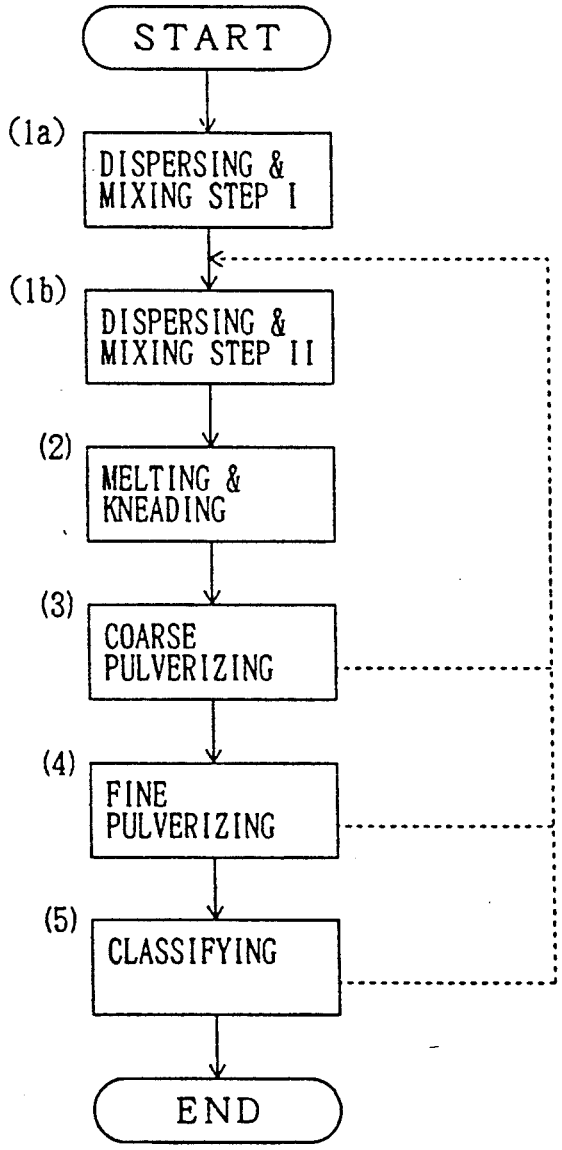
FIG. 2 is a flow chart showing another embodiment of a method of producing an electrophotographic toner according to the present invention.
Figure 3:
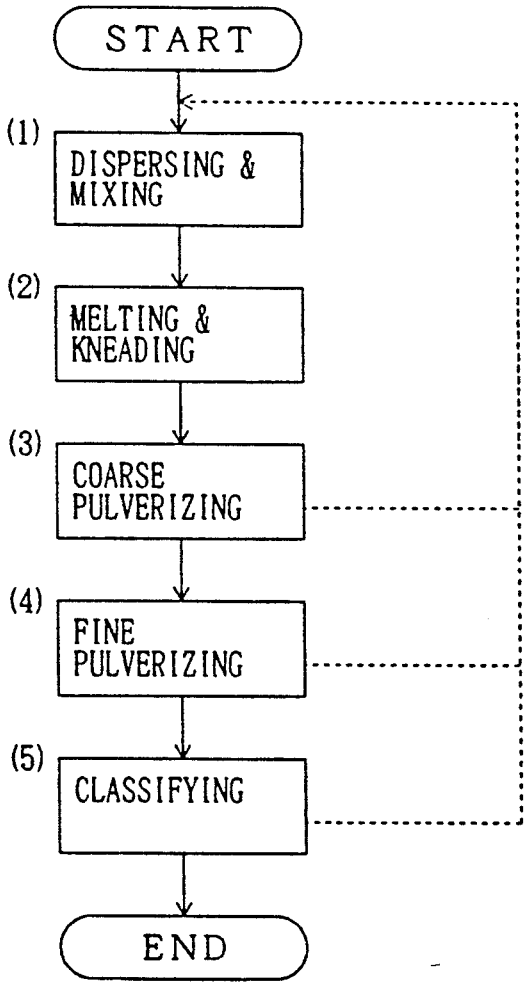
Fig. 3 PRIOR ART
FIG. 3 is a flow chart showing a conventional method of producing an electrophotographic toner.

According to the present invention, as shown in FIG. 2, the fine powder may be added to toner components which have been dispersed and mixed at a dispersing & mixing step I (step 1*a*), and the resulting mixture is uniformly dispersed and mixed at a dispersing & mixing step II (step 1*b*) and then subjected to the steps from the melting & kneading step to the classifying step (steps 2 to 5).

In this case, a dispersing & mixing device with which the dispersing & mixing step I (step 1*a*) has been carried out, may be temporarily stopped, and the fine powder is then added to the mixture of toner components, after which the dispersing & mixing step II (step 1*b*) may be carried out. Thus, the dispersing & mixing steps I and II can be efficiently carried out.

As to the dispersing & mixing steps I and II, the respective working periods of time are not specifically limited. However, it is desired to carry out the dispersing & mixing step I prior to the addition of fine powder for a relatively long period of time in order to sufficiently finely pulverize and mix the toner components. The dispersing & mixing step II after the addition of fine powder may be carried out only in a short period of time because this is a preliminary mixing step for the subsequent melting & kneading step.

Further, it is preferable in view of productivity to set the periods of time of the dispersing & mixing steps I and II such that the total period of time of both steps I and II is equal to the period of time during which the dispersing & mixing step is carried out in the process shown FIG. 1. In this connection, it is preferable that the period of time of the dispersing & mixing step I to be carried out prior to the addition of fine powder, is set to 70 to 80% or more of the dispersing & mixing period of time taken in FIG. 1 in order to sufficiently finely pulverize and mix the toner components, and that the period of time of the dispersing & mixing step II is set to the remaining period of time.

To adjust the surface dye density of an obtainable toner within the range above-mentioned, it is a common practice to adjust the blending proportion of an electric charge controlling dye. In addition, the surface dye density can also be adjusted by adjusting the period of time of the dispersing & mixing step (the dispersing & mixing period of time) in the production of an electrophotographic toner by dispersing & mixing, melting & kneading and pulverizing. Such adjustment of the dispersing & mixing period of time is also effective in adjustment of the toner-surface presence rate of dye within the range above-mentioned.

More specifically, if the dispersing & mixing period of time is short, the electric charge controlling dye does not receive so much a shear force generated by mixing, and is mixed and kneaded in the form of relatively large lumps with the fixing resin. Accordingly, the electric charge controlling dye is present in the form of relatively large lumps on the surface of the toner obtained through the subsequent pulverizing and classifying steps. Thus, the surface dye density and the surface presence rate of dye are liable to be increased.

On the other hand, if the dispersing & mixing period of time is long, the electric charge controlling dye is uniformly dispersed in the fixing resin as finely pulverized upon reception of a shear force generated by mixing. Accordingly, the surface presence rate of dye or the surface dye density which refers to the amount of an electric charge controlling dye exposed onto the surface of the resulting toner, is liable to be lowered.

Since the dispersing & mixing period of time is substantially proportional to the surface dye density of the toner, the surface dye density can be adjusted by adjusting the dispersing & mixing period of time. To adjust the surface dye density in a finer manner, it is preferable to combine the adjustment of the proportion of the electric charge controlling dye with the adjustment of the dispersing & mixing period of time.

For obtaining a predetermined surface dye density or a predetermined surface presence rate of dye, the dispersing & mixing period of time is not specifically limited, but may be suitably determined according to the type of a stirring device to be used, the stirring speed, the blending proportion of the whole toner components and the like.

As far as the toner-surface presence rate of electric charge controlling dye is in the range from 10 to 27% by weight, the surface dye density of toner particles is not specifically limited to the range above-mentioned. In view of reduction in falling of the electric charge controlling dye from toner particles, the surface dye density may be in the range from $1.0\times10^{-3}$ to $4.0\times10^{-3}$ g/g.

According to the present invention, the particle size of the electrophotographic toner is preferably from 3 to 35 μm and more preferably from 5 to 25 μm.

To improve the flowability and electric charging characteristics, the electrophotographic toner of the present invention may be covered at the surface thereof with a surface treating agent (a fluidizing agent). As the surface treating agent, there may be used any of a variety of conventional agents such as inorganic fine particles, fluoroplastic particles and the like. Preferably, there may be used a silica-type surface treating agent containing hydrophilic or hydrophobic silica fine particles such as silica anhydride in the form of microfine particles, coloidal silica or the like.

According to the present invention, the electrophotographic toner may be mixed with a magnetic carrier such as ferrite, iron powder or the like and used as a two-component developer for an image forming apparatus.

The electrophotographic toner according to the present invention may be applied as any of a variety of conventional electrophotographic toners including not only a black toner for normal monochrome image forming, but also a color toner for full-color image forming in which the fixing resin contains a coloring agent and an electric charge controlling dye.

EXAMPLES

The following description will discuss the present invention with reference to Examples thereof and Comparative Examples.

EXAMPLES 1 TO 4 AND COMPARATIVE EXAMPLES 1 TO 2

(Surface Dye Density)

With the use of a Henschel mixer, 100 parts by weight of a styrene-acrylic copolymer as a fixing resin, 10 parts by weight of carbon black as a coloring agent, 2.5 parts by weight of low-molecular-weight polypropylene as an off-set preventive agent, and each of the amounts shown in Table 1 of a chromium-containing monoazo dye as an electric charge controlling dye, were dispersed and mixed for each of the periods of time shown in Table 1, thereby to prepare a mixture. The Henschel mixer was once temporarily stopped after about 95% of each of the dispersing & mixing periods of time in Table 1 has passed from the start of dispersing & mixing, and 30 parts by weight of fine powder was then added to each of the mixtures, after which each of the resulting mixtures was continuously dispersed and mixed for each of the remaining periods of time. As the fine powder, there was used fine powder of each of the toners which had been previously produced with the same proportions and compositions and which had particle sizes of not greater than 5 μm as cut after classified.

Each of the mixtures thus obtained was molten and kneaded with a double-shaft kneader, then subjected to cooling, pulverizing and classifying in a conventional manner, and then treated with silica fine particles as a fluidizing agent, thereby to produce each of electrophotographic toners having the average particle size of 12 μm, of which surface dye densities are shown in Table 1. The surface dye density of each toner was obtained in the following manner.

First, 100 mg of each of the electrophotographic toners was put in 50 ml of methanol, and sufficiently stirred and mixed. Then, the electric charge controlling dye present on the surfaces of the toner particles was extracted. Thereafter, the supernatant liquid with the toner particles precipitated was measured with a spectrophotometer. With the use of a predetermined calibration curve, each surface dye density was calculated from the measured results.

A ferrite carrier having the average particle size of 100 μm and coated at the surface thereof with an acrylic-melamine resin was blended with 100 parts by weight of each of the electrophotographic toners obtained in Examples and Comparative Example above-mentioned. Each blended body was uniformly stirred and mixed to prepare a two-component developer having toner density of 4.5%. The following tests were conducted on the developers thus prepared.

As to the electrophotographic toner of Comparative Example 2 of which surface dye density was greater than $1.7\times10^{-3}$ g/g, the electric charging characteristics of the developer obtained with the use of the carrier above-mentioned, were too strong, so that the initial image density was considerably lowered to 1.212. In this connection, there was prepared a two-component developer having toner density of 4.5%, from the toner of Comparative Example 2 and a ferrite carrier (having the average particle size of 100 μm) coated at the surface thereof with an acrylic resin, and the following tests were conducted on this developer.

Measurement of Initial Image Density

With an electrophotographic copying apparatus (DC-2055 manufactured by Mita Industrial Co., Ltd.) using each of the developers above-mentioned, a black-solid document was copied. Then, the initial image density (I.D.) of each of the copied pieces was measured with a reflection densitometer (Model TC-6D manufactured by Tokyo Denshoku Co., Ltd.).

Measurement of Lifes of Developers

With an electrophotographic copying apparatus (DC-2055 manufactured by Mita Industrial Co., Ltd.) using each of the developers above-mentioned, a black-solid document was continuously copied for 20,000 pieces, which were then checked for "forward flow". During the continuous copying, the electrophotographic copying apparatus was also checked at the circumference of the developing device for toner scattering. The developers which produced no "forward flow" and of which toner hardly scattered around the developing device, were evaluated as good (O). As to the developers which produced either "forward flow" or toner scattering, there were recorded on which copied piece such "forward flow" or toner scattering occurred.

The test results are shown in Table 1.

TABLE 1 (1/2)

| | Added Amount of Dye (parts by weight) | Dispersing & Mixing Period of Time (min.) | Surface Dye Density (g/g) |
|---|---|---|---|
| Example 1 | 0.3 | 5 | $1.12\times10^{-3}$ |
| Example 2 | 0.6 | 15 | $1.02\times10^{-3}$ |
| Example 3 | 0.9 | 15 | $1.43\times10^{-3}$ |
| Example 4 | 1.2 | 30 | $1.56\times10^{-3}$ |
| Comparative Example 1 | 0.3 | 15 | $0.66\times10^{-3}$ |
| Comparative Example 2 | 1.2 | 5 | $4.0\times10^{-3}$ |

TABLE 1 (2/2)

| | Image Density | Life of Developer | Forward Flow | Toner Scattering |
|---|---|---|---|---|
| Example 1 | 1.435 | ○ | None | Little |
| Example 2 | 1.441 | ○ | None | Little |
| Example 3 | 1.434 | ○ | None | Little |
| Example 4 | 1.455 | ○ | None | Little |
| Comparative Example 1 | 1.463 | 4,000 pieces | Occurred | Much |
| Comparative Example 2 | 1.400 | 1,000 pieces | Occurred | Much |

It is apparent from Table 1 that, with the developer containing the electrophotographic toner of Comparative Example 2 of which surface dye density was greater than $1.7\times10^{-3}$ g/g, there occurred, on the 1,000th copied piece, "forward flow" or toner scattering considered to have been caused by a decrease in the electric charging characteristics of the developer due to carrier contamination, so that the life of the developer was short.

It is also apparent from Table 1 that, with the developer containing the electrophotographic toner of Comparative Example 1 of which surface dye density was smaller than $1.0\times10^{-3}$ g/g, there occurred, on the 4,000th copied piece, "forward flow" or toner scattering considered to have been caused by a decrease in the electric charging characteristics of the developer due to insufficient surface dye density, so that the life of the developer was still short even though slightly longer than that of Comparative Example 2.

On the other hand, any of the developers containing the electrophotographic toners of Examples 1 to 4 was excellent in initial image density and presented a life as long as 20,000 pieces or more, and provoked neither "forward flow" nor toner scattering. In this connection, any of the electrophotographic toners of Examples 1 to 4 was excellent in initial electric charging characteristics and involved no possibility of the developer being lowered in electric charging characteristics.

In the continuous copying with the use of the toners of Examples above-mentioned, there was not caused any of troubles such as an increase in fog density, deterioration in formed image, a decrease in transfer efficiency and the like which had been conventionally caused as a result of the addition of fine powder to toner components.

EXAMPLES 5 TO 9 AND COMPARATIVE EXAMPLES 3 TO 4

(Surface Presence Rate of Dye)

With the use of a Henschel mixer, 100 parts by weight of a styrene-acrylic copolymer as a fixing resin, 10 parts by weight of carbon black as a coloring agent, 2.5 parts by weight of low-molecular-weight polypropylene as an off-set preventive agent, and each of the amounts shown in Table 2 of a chromium-containing monoazo dye as an electric charge controlling dye, were dispersed and mixed for each of the periods of time shown in Table 2, thereby to prepare a mixture. The Henschel mixer was once temporarily stopped after about 95% of each of the dispersing & mixing periods of time in Table 2 has passed from the start of dispersing & mixing, and 30 parts by weight of fine powder was then added to each of the mixtures, after which each of the resulting mixtures was continuously dispersed and mixed for each of the remaining periods of time. As the fine powder, there was used fine powder of each of the toners which had been previously produced with the same proportions and compositions and which had particle sizes of not greater than 5 μm as cut after classified.

Each of the resulting mixtures thus obtained was molten and kneaded with a double-shaft kneader, then subjected to cooling, pulverizing and classifying in a conventional manner, and then treated with silica fine particles as a fluidizing agent, thereby to produce each of electrophotographic toners having the average particle size of 12 μm, of which surface dye densities and surface presence rates of dye are shown in Table 2. The surface dye density and surface presence rate of dye of each toner were obtained in the following manner.

First, 100 mg of each of the electrophotographic toners was put in 50 ml of methanol, and sufficiently stirred and mixed. Then, the electric charge controlling dye present on the surfaces of the toner particles was extracted. Thereafter, the supernatant liquid with the toner particles precipitated was measured with a spectrophotometer. With the use of a predetermined calibration curve, each surface dye density was calculated from the measured results.

From the density of each electric charge controlling dye in the entire components (the entire dye density g/g) and the surface dye density (g/g), the surface presence rate of dye (% by weight) was calculated according to the following equation:

Surface Presence Rate of Dye =

-continued

[Surface Dye Density (g/g)/Entire Dye Density (g/g)] × 100

A ferrite carrier (having the average particle size of 100 μm) coated at the surface thereof with an acrylic-melamine resin presenting high electric charging characteristics of the frictional electric charge type, was blended with 100 parts by weight of each of the electrophotographic toners obtained in Examples 5, 6 and Comparative Example 4 presenting low surface dye densities. Each blended body was uniformly stirred and mixed to prepare a two-component developer having toner density of 4.5%.

A ferrite carrier (having the average particle size of 100 μm) coated at the surface thereof with an acrylic resin presenting low electric charging characteristics of the frictional electric charge type, was blended with 100 parts by weight of each of the electrophotographic toners obtained in Examples 7 to 9 and Comparative Example 3. Each blended body was uniformly stirred and mixed to prepare a two-component developer having toner density of 4.5%.

The measurement of initial image density and the measurement of life were conducted on each of the developers thus prepared. The results are shown in Table 2.

TABLE 2 (1/2)

| | Added Amount of Dye (parts by weight) | Dispersing & Mixing Period of Time (min.) | Surface Dye Density (g/g) |
|---|---|---|---|
| Example 5 | 0.6 | 10 | $1.34 \times 10^{-3}$ |
| Example 6 | 0.6 | 15 | $1.02 \times 10^{-3}$ |
| Example 7 | 1.2 | 15 | $1.92 \times 10^{-3}$ |
| Example 8 | 2.0 | 15 | $3.82 \times 10^{-3}$ |
| Example 9 | 2.0 | 30 | $2.14 \times 10^{-3}$ |
| Comparative Example 3 | 0.6 | 5 | $1.96 \times 10^{-3}$ |
| Comparative Example 4 | 2.0 | 60 | $1.67 \times 10^{-3}$ |

TABLE 2 (2/2)

| | Surface Presence Rate of Dye (% by weight) | Image Density | Life of Developer | Forward Flow | Toner Scattering |
|---|---|---|---|---|---|
| Example 5 | 25.2 | 1.438 | ○ | None | Little |
| Example 6 | 19.2 | 1.413 | ○ | None | Little |
| Example 7 | 18.2 | 1.376 | ○ | None | Little |
| Example 8 | 21.9 | 1.345 | ○ | None | Little |
| Example 9 | 12.2 | 1.323 | ○ | None | Little |
| Comparative Example 3 | 36.9 | 1.400 | 1,000 pieces | Occurred | Much |
| Comparative Example 4 | 9.6 | 1.455 | 4,000 pieces | Occurred | Much |

It is apparent from Table 2 that, with the developer containing the electrophotographic toner of Comparative Example 3 of which surface presence rate of dye was greater than 27% by weight, there occurred, on the 1,000th copied piece, "forward flow" or toner scattering considered to have been caused by a decrease in the electric charging characteristics of the developer due to carrier contamination, so that the life of the developer was short.

It is also apparent from Table 2 that, with the developer containing the electrophotographic toner of Comparative Example 4 of which surface presence rate of dye was less than 10% by weight, there occurred, on the 4,000th copied piece, "forward flow" or toner scattering considered to have been caused by a decrease in the electric charging characteristics of the developer due to insufficient surface dye, so that the life of the developer was still short even though slightly longer than that of Comparative Example 3.

On the other hand, any of the developers containing the electrophotographic toners of Examples 5 to 9 was excellent in initial image density and presented a life as long as 20,000 pieces or more, and provoked neither "forward flow" nor toner scattering. In this connection, any of the electrophotographic toners of Examples 5 to 9 was excellent in initial electric charging characteristics and involved no possibility of the developer being lowered in electric charging characteristics.

In the continuous copying with the use of each of the toners of Examples 5 to 9, there was not caused any of troubles such as an increase in fog density, deterioration in formed image, a decrease in transfer efficiency and the like which had been conventionally caused as a result of the addition of fine powder to the toner components.

REFERENCE EXAMPLE (Initial Preparation of Electrophotographic Toner)

With the use of a Henschel mixer, 100 parts by weight of a styrene-acrylic resin as a binding resin, 10 parts by weight of carbon black as a coloring agent, 1 part by weight of a chromium-containing azo dye as an electric charge controlling dye and 2 parts by weight of low-molecular-weight polypropylene as a releasing agent, were dispersed and mixed for 120 minutes, and then heatingly molten and kneaded with a double-shaft extruder. The resulting kneaded body was cooled and solidified, and then coarse-pulverized with a feather mill and fine-pulverized into particles of 10 μm with a jet mill. The resulting particles were classified to cut particles of not greater than 5 μm, so that the particles were made uniform in size. The classified particles with hydrophobic silica added thereto, were treated at the surfaces thereof with a Henschel mixer, thus preparing a toner.

The toner producing process above-mentioned generated fine powder in an amount of 30% by weight of the total weight of the toner raw materials at the fine-pulverizing and classifying steps.

EXAMPLE 10

There was prepared a toner in the same manner as in Reference Example above-mentioned except that, after the toner components had been dispersed and mixed for 120 minutes with a Henschel mixer, the Henschel mixer was once temporarily stopped, and 30% by weight of the fine powder generated in Reference Example was added to the resulting mixture, which was then further dispersed and mixed for 5 minutes.

COMPARATIVE EXAMPLE 5

There was prepared a toner in the same manner as in Reference Example except that, 30% by weight of the fine powder generated in Reference Example was added to the toner components before they were mixed with a Henschel mixer.

The following evaluation tests were conducted on the toners of Reference Example, Example 10 and Comparative Example 5.

Evaluation of Dispersion of Charge Controlling Dye

First, 100 mg of each of the electrophotographic toners was put in 100 ml of methanol, and sufficiently stirred and mixed. The electric charge controlling dye present on the surfaces of the toner particles was then selectively extracted. Thereafter, the absorbance of the supernatant liquid with the toner particles precipitated was measured with a spectrophotometer.

When the dispersion of the electric charge controlling dye in the toner particles is good, the absolute amount of an electric charge controlling dye exposed onto the toner surface and extracted with methanol (which amount corresponds to the amount of an electric charge controlling dye adapted to fall from the toner to contaminate a carrier when the toner is mixed with the carrier under stirring), is reduced to lower the absorbance. With the use of the fact above-mentioned, the dispersion of the electric charge controlling dye in toner particles was evaluated from the measured value of absorbance above-mentioned.

The results are set forth below.

| | (Absorbance) |
|---|---|
| Example 10 | 0.235 |
| Comparative Example 5 | 0.405 |
| Reference Example | 0.241 |

In the toner of Comparative Example 5, the absorbance is higher than in the toner of Reference Example reusing no fine powder. It is therefore expected that the toner of Comparative Example 5 is poor in the dispersibility of the electric charge controlling dye so that the electric charge controlling dye is present, in the form of relatively large lumps, in the toner particles.

On the other hand, the absorbance of the toner of Example 10 is on the same level as in the toner of Reference Example. It is therefore expected that the toner of Example 10 is good in the dispersibility of the electric charge controlling dye so that the electric charge controlling dye is dispersed as finely pulverized in the toner particles.

Measurement of Toner Consumption and Transfer Efficiency

First, 3 parts by weight of each of the toners of Example 10, Comparative Example 5 and Reference Example was blended with 100 parts by weight of a ferrite carrier having the average particle size of 70 μm to prepare a two-component developer. Each of the developers thus prepared was mounted, as a start developer, on an electrophotographic copying apparatus (DC-7085 manufactured by Mita Industrial Co., Ltd.), with which a 6%-document of the A4 size was continuously copied for 100,000 pieces with the same toner as the toner in each developer used as a resupply toner.

There were measured (i) the weight of each toner hopper filled with a resuply toner before continuous copying $M_1$ and (ii) the weight of each toner hopper after 100,000-piece continuous copying $M_2$, from which the toner consumption per A4-size paper piece (mg/paper piece) was calculated according to the following equation:

$$\text{Toner Consumption (mg/paper piece)} = (M_1 - M_2)/\text{Copied Paper Pieces of A4-Size}$$

Further, the amount of each toner collected by the cleaning device of the copying apparatus was measured as $M_3$. From the amount of collected toner $M_3$ and the toner consumption $M_1-M_2$, the transfer efficiency rate (%) of each toner was calculated according to the following equation:

$$\text{Transfer Efficiency } (\%)=[(M_1-M_2)-M_3]/(M_1-M_2)\times 100$$

Measurement of Electric Charge Amount

With the use of a flow tester of Toshiba Chemical Co., Ltd., there were measured the amounts of blow-off electric charge (μC/g) of each developer before and after 100,000-piece continuous copying.

Observation of Contamination of Copied Pieces by Falling Toner

During the 100,000-piece continuous copying, the copied pieces were checked for the degree of contamination due to each toner falling from the developing sleeve.

Measurement of Image Density and Fog Density

Each of the two-component developers above-mentioned was mounted, as a start developer, on the same electrophotographic copying apparatus, with which a black-white document was continuously copied for 100,000 pieces with the same toner as the toner in each developer used as a resupply toner.

Then, the image densities (I.D.) of the first and 100,000th copied pieces were measured with a reflection densitometer (Model TC-6D manufactured by Tokyo Denshoku Co., Ltd.). Further, the densities of blank portions of the first and 100,000th copied pieces were measured as fog densities (FD).

Measurement of Resolution

Each of the two-component developers above-mentioned was mounted, as a start developer, on the same electrophotographic copying apparatus, with which a resolution measuring chart in accordance with the stipulation of JIS B 7174-1962 was continuously copied for 100,000 pieces with the same toner as the toner in each developer used as a resupply toner. The resolution (the number of lines/mm) of each 100,000th copied piece was measured.

Measurement of Image Gradation

Each of the two-component developers above-mentioned was mounted, as a start developer, on the same electrophotographic copying apparatus, with which each of documents having image densities of 0.2 to 1.6 was copied with the same toner as the toner in each developer used as a resupply toner. The image densities (ID) of the copied images were measured with a reflection densitometer (Model TC-6D manufactured by Tokyo Denshoku Co., Ltd.). Developers of which measured results faithfully reproduced all the densities of the original documents, were evaluated as good in gradation, and other developers were evaluated as poor in gradation.

The test results are collectively shown in Table 3.

TABLE 3

| | Example 10 | Comparative Example 5 | Reference Example |
|---|---|---|---|
| Toner Consumption (mg/piece) | 39 | 52 | 40 |
| Transfer Efficiency (%) | 84.7 | 73 | 85 |
| ID: | | | |
| First piece | 1.42 | 1.44 | 1.41 |
| 100,000th piece | 1.40 | 1.45 | 1.40 |
| FD: | | | |
| First piece | 0.003 | 0.008 | 0.002 |
| 100,000th piece | 0.003 | 0.012 | 0.003 |
| Amount of Blow-Off Electric Charge (Before 100,000-piece Copying) | −24.0 | −18.3 | −23.5 |
| Amount of Blow-Off Electric Charge (After 100,000-piece Copying) | −26 | −19 | −27 |
| Resolution (lines/mm) | 7.1 | 4.0 | 7.1 |
| Copy Contamination due to Falling Toner | None | Often after 50,000th piece | None |
| Image Gradation: | | | |
| 1.6 Document | 1.46 | 1.49 | 1.45 |
| 1.4 Document | 1.37 | 1.45 | 1.38 |
| 1.2 Document | 1.23 | 1.42 | 1.24 |
| 1.0 Document | 1.03 | 1.35 | 1.04 |
| 0.8 Document | 0.88 | 1.24 | 0.84 |
| 0.6 Document | 0.66 | 0.69 | 0.68 |
| 0.4 Document | 0.38 | 0.21 | 0.37 |
| 0.2 Document | 0.23 | 0.15 | 0.25 |
| Evaluation of Gradation | ○ | X | ○ |

It is apparent from the results shown in Table 3 that, when the toner of Comparative Example 5 was used for continuous copying, the fog density was suddenly increased, the resolution of the formed images was deteriorated, the toner consumption was high, the transfer efficiency was low, and the copied images were often contaminated by scattering and falling toner on and after the 50,000th copied piece. It is therefore understood that, when continuously used for a long period of time, the toner of Comparative Example 5 deteriorates the developer in electric charging characteristics. Further, it is also understood that, because of its low amounts of blow-off electric charge and its bad gradation of formed images, the toner of Comparative Example 5, itself, is inferior in electric charging characteristics to Reference Example.

On the other hand, it is understood that the toner of Example 10 is on the same level, in any of the characteristics above-mentioned, as in the toner of Reference Example, and the toner itself is excellent in electric charging characteristics and does not deteriorate the developer in electric charging characteristics even though continuously used for a long period of time.

What is claimed is:

1. A method of producing an electrophotographic toner by which toner components containing a fixing resin, a coloring agent and an electric charge controlling dye are dispersed and mixed, melted and kneaded, and then pulverized and classified, and in which fine powder generated at pulverizing and classifying steps are reused in production of a toner, said method comprising the step of adding said fine powder to a mixture of toner components as already dispersed and mixed at a dispersing and mixing step.

2. A method of producing an electrophotographic toner by which toner components containing a fixing resin, a coloring agent and an electric charge controlling dye are dispersed and mixed, melted and kneaded, and then pulverized and classified, and in which fine powder generated at pulverizing and classifying steps are reused in production of a toner, said method comprising a first dispersing and mixing step where said toner components containing a fixing resin, a coloring agent and an electric charge controlling dye are dispersed and mixed, and a second dispersing and mixing step where a resulting dispersed mixture of said toner components from said first dispersing and mixing step with said fine powder added thereto and is dispersed and mixed.

* * * * *